United States Patent [19]

Sturdevant

[11] Patent Number: 4,501,954

[45] Date of Patent: Feb. 26, 1985

[54] MECHANICAL ELECTRODE

[75] Inventor: Eugene J. Sturdevant, Wilmington, Del.

[73] Assignee: Proctor-Silex, Inc., Chillicothe, Ohio

[21] Appl. No.: 507,739

[22] Filed: Jun. 27, 1983

[51] Int. Cl.[3] ..... F24C 7/00

[52] U.S. Cl. ..... 219/399; 165/96; 219/392; 219/404

[58] Field of Search ..... 219/392, 399, 402, 404, 219/10.81, 391, 394, 395, 396, 397, 398, 403, 280, 281; 165/1, 96; 174/16 R; 361/229, 230; 264/22, 25, 26, 27; 250/324, 325, 326; 422/186.04; 425/174.4, 174.6, 174.8 E, 174.8 R

[56] References Cited

U.S. PATENT DOCUMENTS

| | | | |
|---|---|---|---|
| 2,503,224 | 4/1950 | Trump | 361/230 |
| 3,585,448 | 6/1971 | Simons | 361/230 |
| 3,684,364 | 8/1972 | Schmidlin | 361/230 |
| 4,238,668 | 12/1980 | Mammen | 219/392 |

*Primary Examiner*—Roy N. Envall, Jr.
*Assistant Examiner*—Teresa J. Walberg
*Attorney, Agent, or Firm*—Frost & Jacobs

[57] ABSTRACT

A mechanical electrode is disclosed for use in an electrical circuit in a cooking device, such as, an oven. The mechanical electrode includes a plurality of electrically conductive needle elements supported on a flat base plate. Each needle has a sharply pointed tip for establishing current contact through an electrical field with a food supplied with a voltage normally sufficient to generate corona current from the tip to an aligned surface of the food for enhancing heat and mass transfer. A current-limiting resistive material electrically connects each one of the needle elements to the base plate which, in turn, is electrically coupled to a voltage supply for regulating the voltage supplied to the food to complete the electrical circuit. The current-limiting resistive material forming a discrete path of electrical resistance along each needle so that any excessively high voltage concentration about any needle is restricted through the resistive material and confined to individual needles for suppressing arc formation. In this manner high voltage in the electrical field is avoided, the voltage supply is protected from receiving any sudden high voltage surge and adjacent needle elements are allowed to continue in corona current generating operation.

11 Claims, 11 Drawing Figures

MECHANICAL ELECTRODE

BACKGROUND OF THE INVENTION

1. Field of the Invention

The present invention relates to electrodes used in an electrical circuit of a cooking appliance, such as, an oven or the like for enhancing heat and mass transfer. More particularly, the invention relates to a needle-like mechanical electrode having a current-limiting resistive material associated with each needle. The present application is particularly adapted for use in connection with a needle electrode circuit, such as is disclosed in my copending application entitled Enhanced Heat and Mass Transfer Apparatus, filed Apr. 25, 1983 under U.S. Ser. No. 488,556 and having the same assignee. To the extent appropriate to the present invention the disclosure of the above-identified copending application is incorporated herein by reference.

2. Description of the Prior Art

In an electrical circuit having two spaced apart electrodes defining an electrical field for establishing current contact between two electrodes, the problem of arcing across the field needs to be addressed.

In the above-identified copending application there are disclosed two pairs of electrodes that electrically participate to enhance heat and mass transfer of food being cooked in an oven appliance. One pair of electrodes comprises a food surface and an array of electrically conductive needle-like elements spaced opposite from the food surface to define an electrical field therebetween. A voltage supply is electrically coupled to the food so that the food supplies the voltage necessary for causing the tip of each needle to generate a corona current through the field to an aligned portion of the food surface for maximizing heat and mass transfer, as is disclosed in the mentioned copending application. In normal operation, the voltage supplied of the food is controlled so as to maintain constant corona current flow through the field and the voltage about each needle is sufficiently above a corona threshold voltage—that voltage necessary to generate corona current—and below a voltage causing arcing.

It is known that the highest electrical concentration in the electrical field is formed about the tip of each needle. Although the tip of each needle is properly spaced from the food surface and the voltage supplied from the food provides corona current operation without arcing, isolated incidences of arcing have been observed to occur between an individual needle tip and the food surface. A localized arcing incidence is believed attributed to a rise in the corona current driving potential concentrating about a needle tip due, for example, to the introduction of mass matter in the field causing the dielectric resistance of the field to be reduced, such as, may occur during the forming of a liquid droplet or the deforming of a food portion to within the field projecting towards the needles.

Arcing is a highly objectionable occurrence because an arc is distracting to the operator and, more importantly, an arc introduces a high voltage surge accompanied by increased current in the circuit that may force electrical components to their operating limit which without regard may damage the components or cause the circuit to momentarily "shut down" until the arc disappears. Accordingly, there is a need to provide a mechanism for rapidly suppressing an arc without exposing electrical components to any excessive electrical activity associated with arcing and without interrupting the electrical operation of the circuit.

A widely used mechanism to achieve arc suppression includes interposing a series resistor in one leg of the electrical circuit to locate the resistor on a line extending from the needle electrode. In operation, a high voltage surge from any one needle of the electrode due to arcing is restricted through the resistor and protection of subsequent electrical components is afforded. Unfortunately, this single resistor mechanism has the disadvantage of reducing the entire operating efficiency of the electrical circuit during an arc suppressing operation and, therefore the overall performance of the circuitry suffers. Another disadvantage of this mechanism is that individual needles are not electrically isolated among one another so that a relatively short arcing duration may still occur which would rob the corona current driving potential from surrounding needles and thereby render the adjacent needles corona inactive during arcing.

From the foregoing, it is seen that there is a need of further improvement in needle electrodes to make the performance of such electrodes less sensitive to an arcing condition at one needle so that the remaining needles may continue to operate to generate corona current without interruption and without any appreciable loss of their corona current driving potential.

SUMMARY OF THE INVENTION

The present invention sets forth a mechanical electrode including a plurality of corona current generating needle elements having an electrical current-limiting resistive material individually associated with each needle for the purpose of suppressing an arc at any one needle without influencing the corona current operation of the remaining needles. A flat plate supports the plurality of needles and the electrical resistive material is interposed to electrically connect each needle element to the plate.

Particular embodiments of the invention are disclosed according to the basic principles taught herein for electrically isolating a needle element under arcing conditions so as to permit the remaining needles of the electrode to continue in corona current operation.

Accordingly, a principal object of the invention is to improve the reliability and efficiency of a needle type electrode used in a thermo transfer appliance such as an oven.

More specifically, it is an object of the invention to provide a mechanical electrode which is less sensitive to an arcing condition at any one needle element.

Other advantages and features will become evident from the following description and claims taken in conjunction with the appended drawing.

DETAILED DESCRIPTION OF THE PREFERRED EMBODIMENTS

Figure 1:
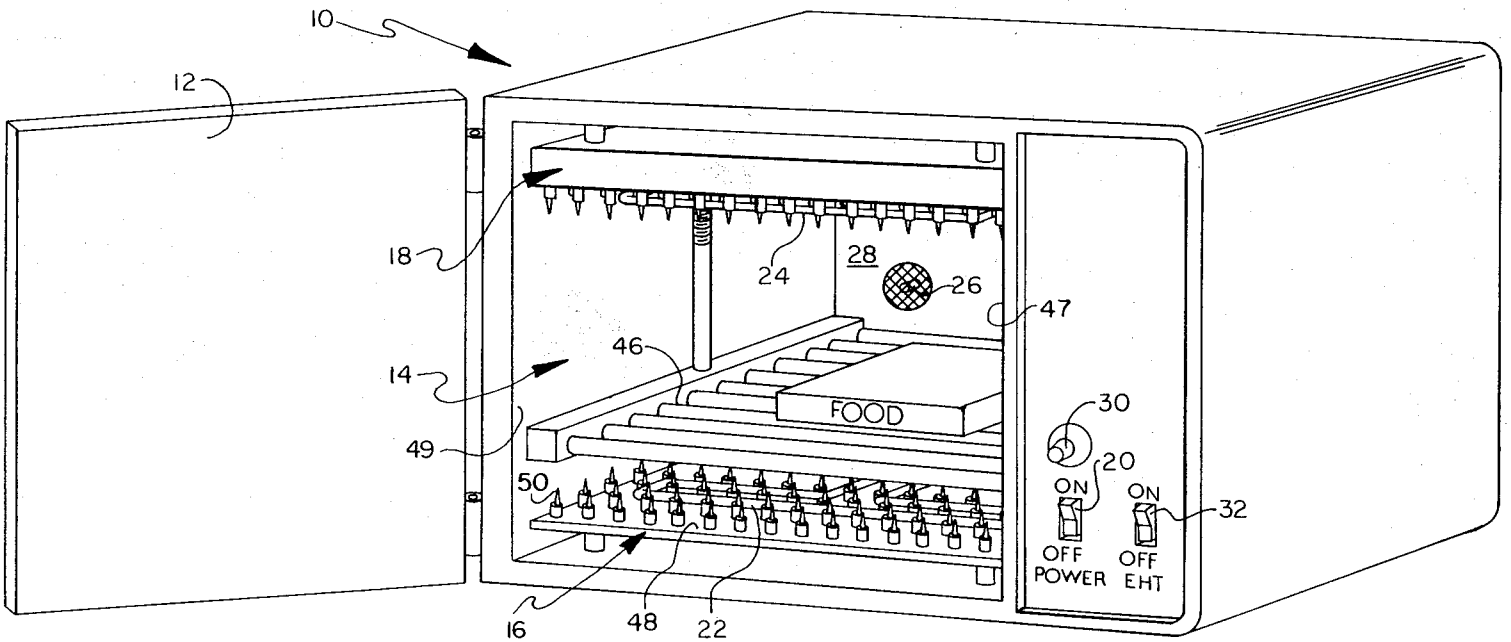
FIG. 1 is a front perspective view showing a mechanical electrode built in accordance with the teachings of the present invention and embodied in an oven appliance.

As illustrated in FIG. 1, an oven appliance 10 is shown having an oven door 12 swung open to expose an oven chamber 14 in which a food is housed for cooking. The preferred oven appliance 10 embodiment is basically constructed in accordance with the teachings disclosed in the previously mentioned copending application wherein a first lower electrode 16 and an second upper electrode 18 electrically operate in conjunction with the food which is supplied with high voltage to produce corona current for enhancing heat and mass transfer to reduce the food cooking time over conventional ovens. Generally, oven appliance 10 includes a main power ON/OFF switch 20 electrically coupled to selectively power a lower heating element 22 and an upper heating element 24 for heating the air within the oven chamber 14. The temperature in oven chamber 14 is thermostatically controlled by a conventional temperature sensor element 26 located along a back wall 28 of the chamber 14. A temperature control knob 30 is utilized to permit the operator to selectively adjust the oven temperature to a desired setting, as is common. Another ON/OFF switch 32 enables the operator to selectively activate the electrodes 16 and 18 for enhanced heat transfer "EHT" mode of operation according to the disclosure in the parent copending application.

Figure 2:
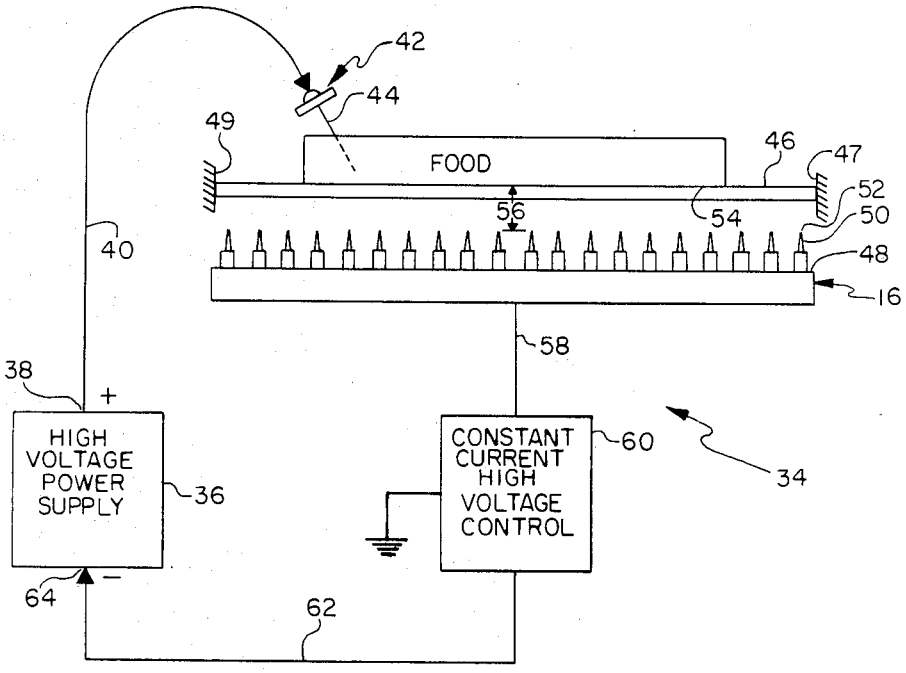
FIG. 2 is a schematic diagram of an electrical circuit including the mechanical electrode.

In FIG. 2 there is shown in schematic form an electrical circuit 34 in connection with the lower electrode 16. The electrical circuit 34 includes a High Voltage Power Supply 36 having a positive output terminal at 38 electrically coupled to an output line 40. The High Voltage Power Supply 36 is a constant current output DC (Direct Current) positive high voltage supply whose output current from terminal 38 is both adjustable and regulated. The Power Supply 36 is operated from the usual household electrical source (not shown) ranging between 105 to 135 volts AC (Alternating current) and is made from known electrical components to impress a high voltage of between 3500 volts and 35,000 volts to the food. An electrical probe 42 has a conductive shaft 44 extending within the food. The conductive shaft 44 is electrically connected to the line 40 for communicating the electrical output from the terminal 38 of the High Voltage Power Supply 36 to the food. The food is supported above the electrode 16 on a plurality of rods 46 rigidly attached to side walls 47 and 49 of oven chamber 14. The rods 46 are made from an electrically non-conductive material, such as, a silica material, so that the food in chamber 14 is electrically isolated from oven structure. Electrode 16 basically comprises a flat base plate 48 supporting a plurality of electrically conductive needle elements 50. Each needle element 50 has a sharply pointed tip end 52 projecting towards rods 46 and those tips 52 aligned directly beneath a bottom food surface 54 defining a current supporting electrical field denoted by reference numeral 56. A line 58 is electrically coupled to communicate the total conducted current from the needles 50 to a known Constant Current High Voltage Control unit 60. A line 62 extends from the Constant Current High Voltage Control unit 60 to the High Voltage Power Supply 36 being electrically coupled at a minus terminal 64 of the Power Supply 36 to complete the electrical circuit 34.

In operation, high voltage is supplied from the High Voltage Power Supply 36 to the food through line 40 and the conductive shaft 44 of probe 42. The actual voltage supplied to the food varies and is regulated in the electrical circuit 34 so as to maintain optimum corona current flow in electrical field 56. The voltage necessary to produce optimum corona current depends on factors, such as, oven temperature, the gap distance of the electrical field 56 separating the tips 52 from the bottom food surface 54, the dielectric properties of the food substance and the dielectric properties resisting current flow in the electrical field 56. The electrode 16, which is operated at close to ground potential, conducts current as a result of the voltage supplied to the food through electrical field 56 to the tips 52 of needle elements 50 located beneath the food. The conducted current at tips 52 is normally sufficient to cause the tips 52 to generate corona current through the electrical field 56 to the food surface 54 for enhancing heat and mass transfer at the surface 54. According to the copending patent application, Ser. No. 488,556, each needle 50 is operating to conduct 6.25 $\mu$A (microamperes) to generate optimum corona current. The total conducted current from the needle elements 50 is supplied on line 58 to the Constant Current High Voltage Control 60 which is operated according to the disclosure of the copending application to generate a signal on line 62 to the High Voltage Power Supply 36. The signal appearing on line 62 is a representation of the conducted current on line 58 with respect to the current necessary to produce optimum corona current density (25 $\mu A/in^2$) in electrical field 56 and is utilized in the High Voltage Power Supply 36 to regulate the voltage output to the food for delivering the voltage necessary for maintaining optimum corona current density.

The preferred embodiment of FIG. 2, the gap distance of electrical field 56 between tips 52 and food surface 54 is in a range of approximately 0.4 inch to 0.8 inch or about 1 cm to 2 cm (centimeters). The needle elements 50 are equally spaced apart at about 0.5 inch (1.27 cm). The exact number of the needle elements 50 may, of course, be varied to suit the particular application. At room temperature (70° F. or 21° C.) the dielectric current resistance of the electrical field 56 has been found to be on the order of 1000M (megohm) or $1 \times 10^9$ ohms. The dielectric field resistance is known to reduce in relation to increasing temperatures above room temperature. Normally the electrical circuitry 34 of FIG. 2 is operating such that the driving potential about each needle tip 52 is above the corona current threshold voltage (found to range between 3000 volts and 3500 volts) and below arcing potential (found to range between 10,000 volts and 12,000 volts at room temperature) and is made to vary therebetween in order to produce optimum corona current flow in the electrical field 56. The arcing potential is known to become reduced as the field temperature rises, for example, when the oven temperature is at about 400° F. the arcing potential is in a range between 7000 volts and 9000 volts for the described embodiment of FIG. 2.

The present invention is addressed to solve the problem of arcing incidents that may occur at discrete needle 50 locations during normal operation of the above-described electrical circuit 34. Arcing or the forming of a plume has been observed to occur at discrete needle 50 locations and is caused when the current driving potential concentration about tip 52 is elevated towards arcing potential. For example, the appearance of a liquid droplet in the electrical field 56 changes the current resistive properties at that portion of the field 56 and may cause arcing. Arcing is undesirable because it interferes with the corona current operation of the needles 50 and it reduces the overall operating efficiency of the electrode 16 because arcing at one needle 50 robs current from adjacent needles 50 so that enhanced heat and mass transfer suffers.

Accordingly, the present invention sets forth a mechanical electrode 16 constructed in accordance to the present disclosure so that discrete arc suppression is accomplished without interrupting or noticeably reducing the overall corona current operating efficiency in the enhanced heat and mass transfer circuit 34.

Figure 3:
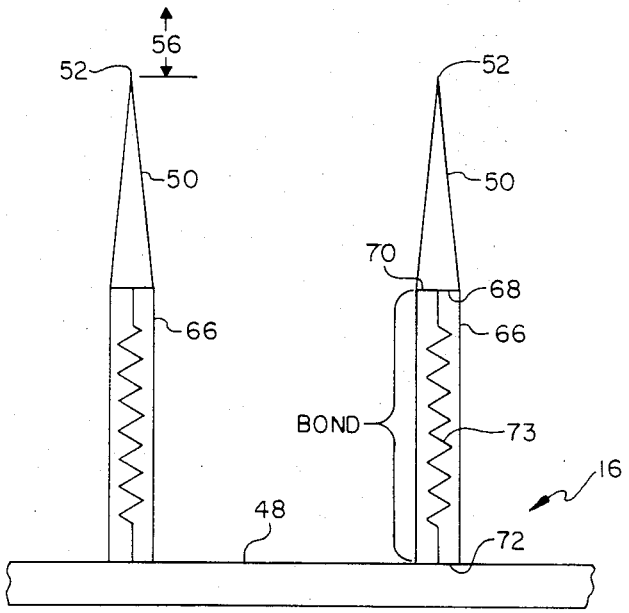
FIG. 3 is an enlarged front elevation view of a mechanical electrode illustrating the basic principles of the present invention.

Several embodiments of the present mechanical electrode 16 are disclosed herein in connection with FIGS. 3–7. In FIG. 3 there is shown the basic teaching comprising the mechanical electrode 16 of the present invention. I have discovered that the foregoing arcing problem can be substantially solved by interposing a current-limiting resistor 66 between each needle element 50 and the flat base plate 48 so that a sudden increase of the current driving potential toward arcing may be dropped through the resistor 66 to prevent localized arcing in the field 56.

In FIG. 3, the mechanical electrode 16 comprises the plurality of electrically conductive needle elements 50 supported in a perpendicular relationship on the base plate 48. The tips 52 are uniformly spaced above the plate 48. As is referenced in connection with one common needle 50, a flat end 68 located opposite the tip 52 is supported on one flat end 70 of the resistor 66. The other flat end 72 of the resistor 66 is supported on the base plate 48. A suitable bonding agent may be used to firmly attach the end 68 of the needle element 50 to the end 70 of resistor 66 and to secure the other end 72 of the resistor 66 to the base plate 48. The bonding agent is not restrictive provided electrical current contact may be established between the needle element 50 and the resistor 66 and between the resistor 66 and the base plate 48. In the embodiment of FIG. 3, the flat base plate 48 is made from a metallic electrically conductive material such as aluminum for supporting current conducted by all needle elements 50. Each needle element 50 is preferably constructed in the form of a standard No. 7 steel sewing needle cut short to make flat surface 68.

The current-limiting resistor 66 electrically connects individual needle elements 50 to the base plate 48 to form a discrete path, represented by line 73, of electrical resistance for the current conducted by the needle element 50. When the voltage concentration about any one needle tip 52 is caused to rise towards an arc forming potential, the increasing voltage is dropped across the resistor 66 to reduce the voltage about the needle 50 and thus extinguish arcing. Any excessive electrical activity associated with arcing is confined to the individual needle elements 50 and corona generating operation of that needle is momentarily stopped until the arcing condition disappears. Adjacent needles are essentially not effected because they are allowed to continue to support their driving potential and therefore remain in corona contact to the food surface 54.

I have discovered that the resistance value associated with each current-limiting resistor 66 should be of the order of 5% to 20% of the normal field resistance to corona current flow. In the preferred enhanced heat and mass transfer electrical circuit 34 of FIG. 2, it will be recalled that the electrical field 56 supports a normal resistance of about $1\times10^9$ ohms at room temperature. Therefore, the value of the current-limiting resistor 66, preferably, may be of the order of $0.1\times10^9$ ohms. Of course, the resistor 66 value, the number and arrangement of needle elements 50, as well as the voltage supplied to the food may be varied to suit the particular application.

During normal enhanced heat and mass transfer operation, each tip 52 of needle element 50 generates a corona current of about 6.25 microamperes and about 500 volts is dropped across each related current-limiting resistor 66. Approximately 3000 volts to 3500 volts is required to overcome the corona threshold voltage and about another 3500 volts is normally dropped in the electrical field 56 between each tip 52 and the opposing portion of the food surface 54. Should the resistive capacity in the electrical field 56 be changed, due to the formation of a liquid droplet or an irregularity of the food surface 54, local field strength is caused to rise and the corona current driving potential about the related aligned needle 50 is caused to rise. When the conducted current at one needle 50 rises to about 40 microamperes corona current, which is well below plumes (1 milliampere) and arcs (1 ampere), approximately 4000 volts is dropped across the resistor 66 and in conjunction with the corona current threshold voltage (3000–3500 volts), there is less voltage left to generate corona current at that one needle 50 so that electrical corona participation of that needle 50 decreases. The overall conducted current at base plate 48 drops slightly by a factor of about one needle 50 because the remaining needles 50 continue to generate corona current and the voltage supplied to the food may rise slightly to compensate for the affected needle 50. Normal corona current operation is resumed at an affected needle 50 when the excessively high corona current driving potential concentration about tip 52 is caused to become reduced due to the disappearance of the arcing condition.

Figure 4A:
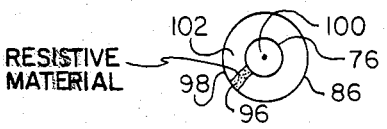
FIG. 4A is a top plan view of one needle according to the embodiment of FIG. 4.
Figure 4:
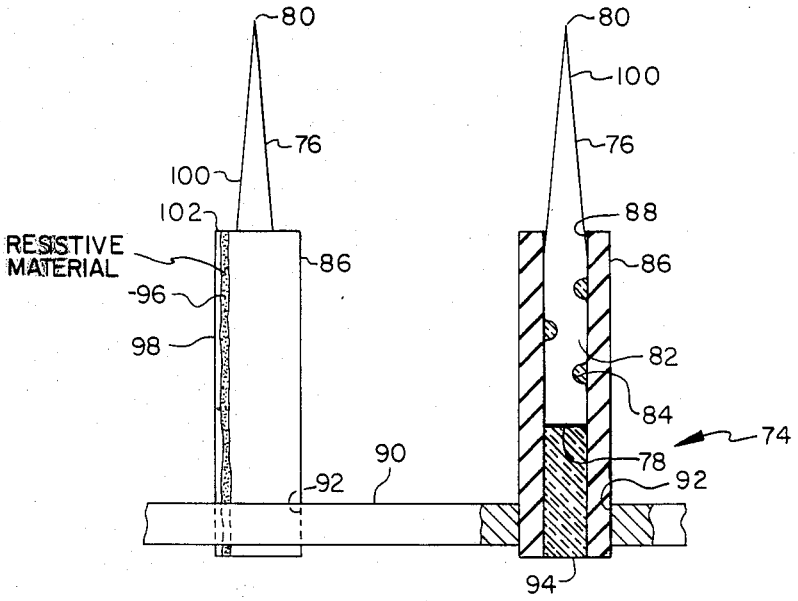
FIG. 4 is a view similar to FIG. 3 of a more preferred embodiment of a mechanical electrode according to the invention.

In the more preferred embodiment of FIGS. 4, and 4A a mechanical electrode 74 comprises a plurality of electrically conductive metallic needle elements 76. Each needle element 76 is preferably in the form of a standard No. 7 steel sewing needle cut to make a flat surface 78 spaced approximately 11/16 inch (0.6875 inch) from the sharply pointed tip 80. A blunt end 82 of the needle element 76 has a few (2 or 3) notches 84 cut along the length perpendicular to the axis of each needle 76 located within a short distance (approximately 3/16 inch or 0.1875 inch) from the flat surface 78. A tubular shaped housing 86 is provided for each needle element 76 and has a through opening 88 sized to closely receive the blunt end 82 of the needle element 76. One housing 86 is sectioned in FIG. 4 to show the assembly of needle 76 in detail. The housing 86 is made from an electrically insulative ceramic material such as one made commercially available by an Omega company identified by number 350 ORA 132116. This material is chiefly composed of alumina porcelain which includes heat resistant properties. A flat plate 90 forms the base of the electrode 74 for supporting the needle elements 76 in upright fashion having the tip 80 of the needle elements 76 extending towards the food. As in the embodiment of FIG. 3, the flat plate 90 is made from an electrically conductive metallic material such as aluminum for supporting current conducted through the needle elements 76. A plurality of holes 92 are drilled through the plate 90 according to the number and spaced relationship among the needles 76. Each hole 92 is sized to closely receive the ceramic housing 86 which is held fixed to the plate 90 by a suitable adhesive. The tip 80 of each needle 76 is located above the plate 90 approximately 1 inch. The one typical section in FIG. 4 shows a gas tight ceramic paste filler 94, such as, supplied by Sauereisen #1 cement or Aremco #552 ceramic paste. The paste filler 94 is used to fixedly support the needle 76 in the opening 88 of the housing 86 and is applied in a pliable state to completely fill the opening 88 beneath flat end 78 of needle 76 and along the blunt end 82 to fill the notches 84 so that when the paste filler 94 is cured to a hardened state the needle 76 is firmly attached to the housing 86.

According to the teachings of the present invention, a cermet electrical resistive ink 96 is painted along an outside surface 98 of housing 86. As is shown in FIGS. 4A and 4, the cermet resistive ink 96 is applied in contact to the exposed pointed end 100 of the needle 76, extending along the top 102 and vertically along the outside surface 98 of each housing 86 to contact plate 90. Thus, the current-limiting resistive ink material 96 forms a path of electrical resistance connecting individual needle elements 76 to the conductive base plate 90. A suitable cermet resistive ink material 96 is made commercially available by a Cermalloy company supplied under the designation series 872. This cermet resistive ink material 96 has electrical resistance properties yielding approximately 20 megaohms per square unit. In the embodiment of FIG. 4, enough quantity of cermet resistive ink material 96 is used so as to form a finished resistor of about $0.1 \times 10^9$ ohms connecting each needle element 76 to the conductive base plate 90. The current-limiting resistive material 96 performs like resistor 66 of the previously described embodiment of FIG. 3. Of course, the number and arrangement of needles 76 and electrical values may be varied to suit the particular application.

Figure 5:
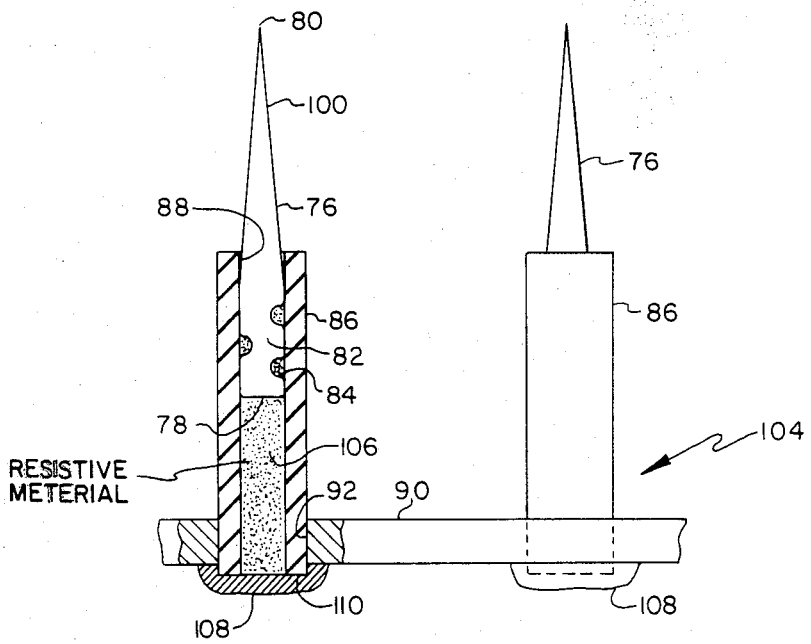
FIG. 5 is a view similar to FIG. 4 of a another embodiment of a mechanical electrode according to the invention.

In FIG. 5 there is shown another embodiment of a mechanical electrode 104 according to the teachings of the present invention. Some of the component parts in FIG. 5 are identical to parts shown and described in connection with the embodiment of FIG. 4. The common component parts in FIG. 5 have been assigned the same reference numeral used in FIG. 4. Each needle element 76 of FIG. 5 is supported within opening 88 and attached to the insulative housing 86 through a harden cermet current-limiting resistive material 106. The cermet filler 106 has electrical resistive properties and is preferably the Cermalloy series 872 material previously described in connection with resistive path 96 of FIG. 4. One housing 86 is sectioned in FIG. 5 to show the cermet filler 106 material completely filling the opening 88 beneath the needle 76. A cermet electrically conductive paste 108 completely covers end 110 of housing 86 to form an ohmic connection between cermet filler 106 and the base plate 90. A suitable cermet conductive paste 108 is commercially available, such as, supplied by Cermalloy, under the designation series 4026.

As in the embodiments previously described, enough of the current-limiting cermet filler material 106 may be used to provide an electrical resistance of the order of $0.1 \times 10^9$ ohms connecting each needle element 76 to the conductive plate 90 to operate as in the previously described embodiments. Of course, the number and arrangement of needles 76 may be varied to suit the particular application.

Figure 6:
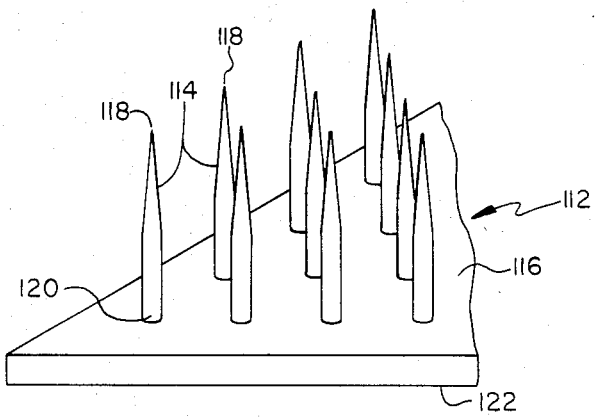
FIG. 6 is a front perspective view showing still another embodiment of a mechanical electrode according to the invention.
Figure 7:
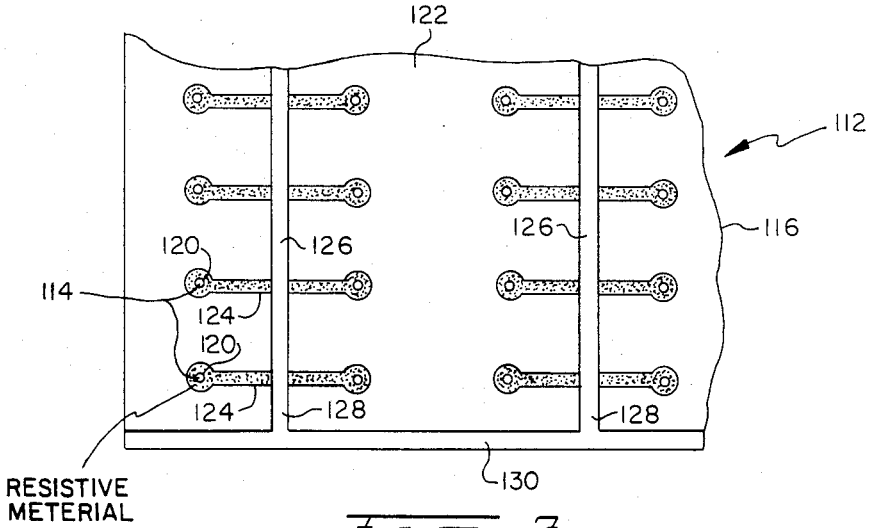
FIG. 7 is a bottom plan view of the embodiment of the mechanical electrode of FIG. 6.

FIGS. 6 and 7 illustrate a mechanical electrode 112 according to the teachings of the present invention comprising a plurality of conductive needles 114 supported in upright fashion by an electrical insulator base plate 116 made from a ceramic non-conductive material such as an alumina porcelain having heat resistive properties. Each needle 114 is preferably in the form of the standard No. 7 steel sewing needle cut to a length having tip 118 located about 1 inch above plate 116. The blunt end 120 of needles 114 project through the plate 116 to terminate slightly beneath a bottom surface 122 of the plate 116.

In the bottom view FIG. 7 there is shown, typically, a stripe or path 124 of cermet electrical resistive ink material associated with each needle 114. A layer of the cermet resistive material is painted in contact with the end 120 of each needle 114 and extends away therefrom along the bottom surface 122 of the plate 116. Lines 126 are traced along the bottom surface 122 of the plate 116 to extend intermediate pairs of rows of needles 114. The lines 126 are fabricated from a cermet electrical conductive material. The cermet resistive path 124 extending from each needle 114 is integrally joined to one related line 126 of cermet conductive material to permit electrical communication therebetween. An end 128 of each line 126 is integrally joined to a main line 130, also made from the cermet conductive material, extending along the bottom surface 122 in perpendicular relation to the lines 126. The main line 130 serves to support current conducted by all corona active needles 114 and is electrically coupled (not shown) to the High Voltage Power Supply 36 through the Constant Current High Voltage Control unit 60 in the electrical circuit of FIG. 2. The cermet resistive material comprising the individual stripes or paths 124 is composed of the mentioned Cermalloy series #872 material and the cermet conductive material comprising line traces 126 and 130 is composed of the mentioned Cermalloy series #4026 material.

As in the embodiments previously described, the discrete path 124 from each needle 114 forms a current-limiting resistor having sufficient electrical resistance properties to suppress an arc by extinguishing corona current operation of individual needles 114 when the corona current driving potential about the tip 118 of any one needle 114 is caused to rise towards arcing potential. As in the previous embodiments, the cermet resistive material may be of the order of $0.1 \times 10^9$ ohms resistance along the path 124 extending from each needle element 114 to the related conductive line 126. Of course, the number and arrangement of needles 114 may be varied to suit the particular application.

An alternative embodiment of the invention according to the arrangement illustrated in FIGS. 6 and 7 would be to cast mold the configuration of the individual needles 114 from the cermet resistive material such as the Cermalloy series #872 material. In this regard, the needle 114 material would serve as the current-limiting resistor and the path 124 electrically connecting individual needles 114 to the line 126 may be made from the cermet conductive material such as the Cermalloy series #4026 material.

An important aspect of the present invention relates to the electrical relationship between the first electrode comprising the bottom food surface 54 and, for example, the mechanical electrode 74 of FIGS. 4 and 4A, in that the electrical field 56 must be free from any oven structure that may interfere with corona current flow between the tip 80 of any needle 76 and its opposing portion of the food surface 54. Therefore, the relative positioning of food support rods 46 with respect to the tip 80 of needles 76 needs to be controlled in order to prevent the rods 46 from electrically interfering with the corona current operation.

Figure 8:
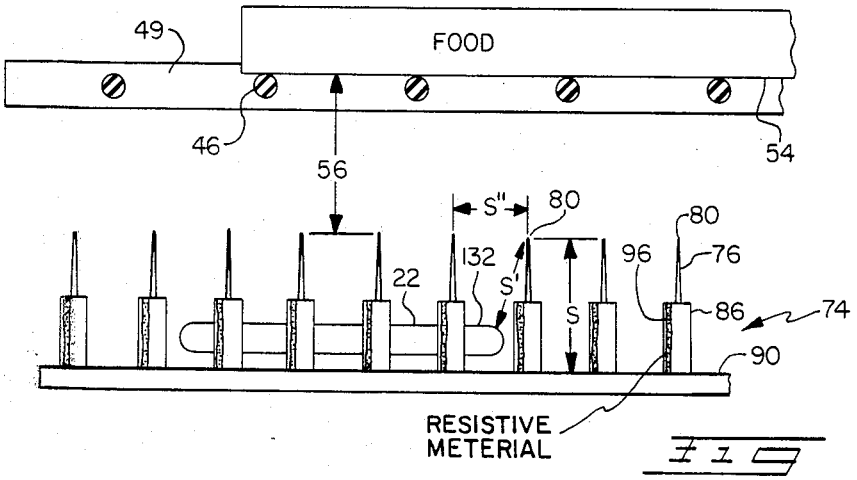
FIGS. 8 and 9 are a side elevation view and a top plan view, respectively, illustrating the preferred relationship between needles of the mechanical electrode according to the embodiment of FIGS. 4 and 4A and oven structure including the food support rods and heating element.
Figure 9:
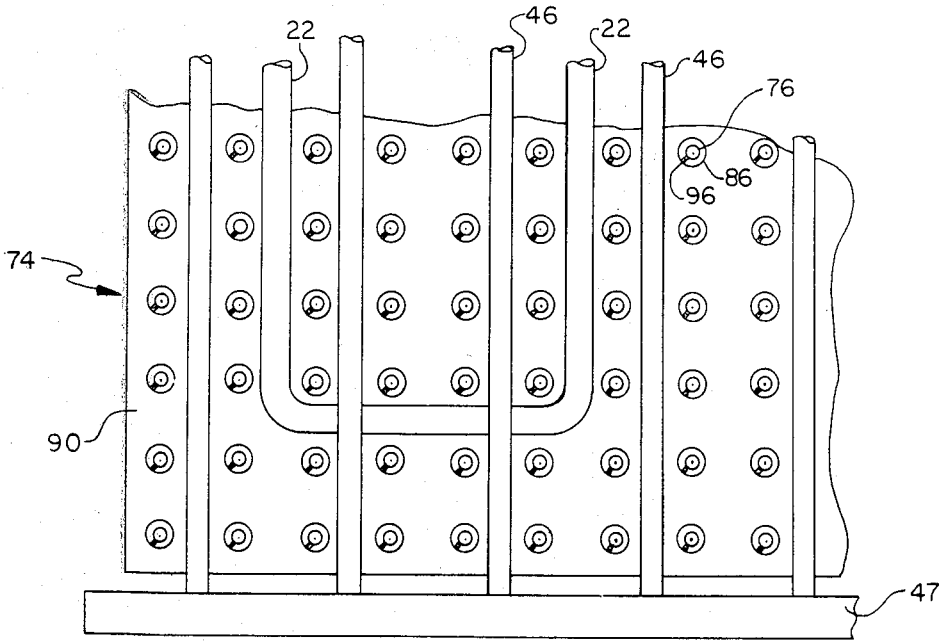

FIGS. 8 and 9 illustrate the preferred relationship between the food support rods 46 and the needles 76. The electrically insulative rods 46 are supported along the spaced oven walls 47, 49 and extend therebetween in parallel relation with respect to the even rows of needles 76 as well as one other as best comprehended in view of FIG. 9. In FIG. 9, it can be seen that the rods 46 are periodically spaced so as to have a displaced or misaligned horizontal relationship to the needles 76. The rods 46 are horizontally located approximately equidistant between an adjacent pair of rows of needles 76. Thus, the electrical field 56 above each needle tip 80 is free from any rod 46 obstacle and direct electrical contact may be established to the opposing portion of the food surface 54 to generate corona current from all needle tips 80 for maximizing heat and mass transfer at food surface 54.

Since the needles 76 of the active electrode 74 are individually a source of corona current producing a corona wind directed towards a portion of the bottom food surface 54, the most effective use of an electrode pair (54, 74) is derived by distributing the lower heating element 22 among the array of needles 74 so that freshly heated air molecules may be carried by the corona wind of each needle 76 directly towards the bottom food surface 54. These local corona winds impinging on the bottom food surface 54 displace gas molecules which have participated in the heat exchange process having given up their thermo energy and are recirculated to the distributed heating element 22 where they are reheated.

In FIG. 8, the lower heating element 22 is fixedly supported located just above plate 90 and beneath needle tips 80. The heating element 22 is a continuous elongated element curve formed among the needles 76 so as to be equidistantly spaced between adjacent needles 76 as best shown in FIG. 9. Thus, the heating element 22 is situated among the needles 76 so as not to interfere in the corona current wind generating operation.

In order to further guard against arcing, the tip 80 of each needle 76 needs to be located a sufficient distance away from conductive structures, such as, the base plate 90 and heating element 22. Proper spacing of the needle tip 80 away from these conductive structures provides a sufficient separation gap therebetween for supporting the normal corona current driving potential without arcing.

Figure 10:
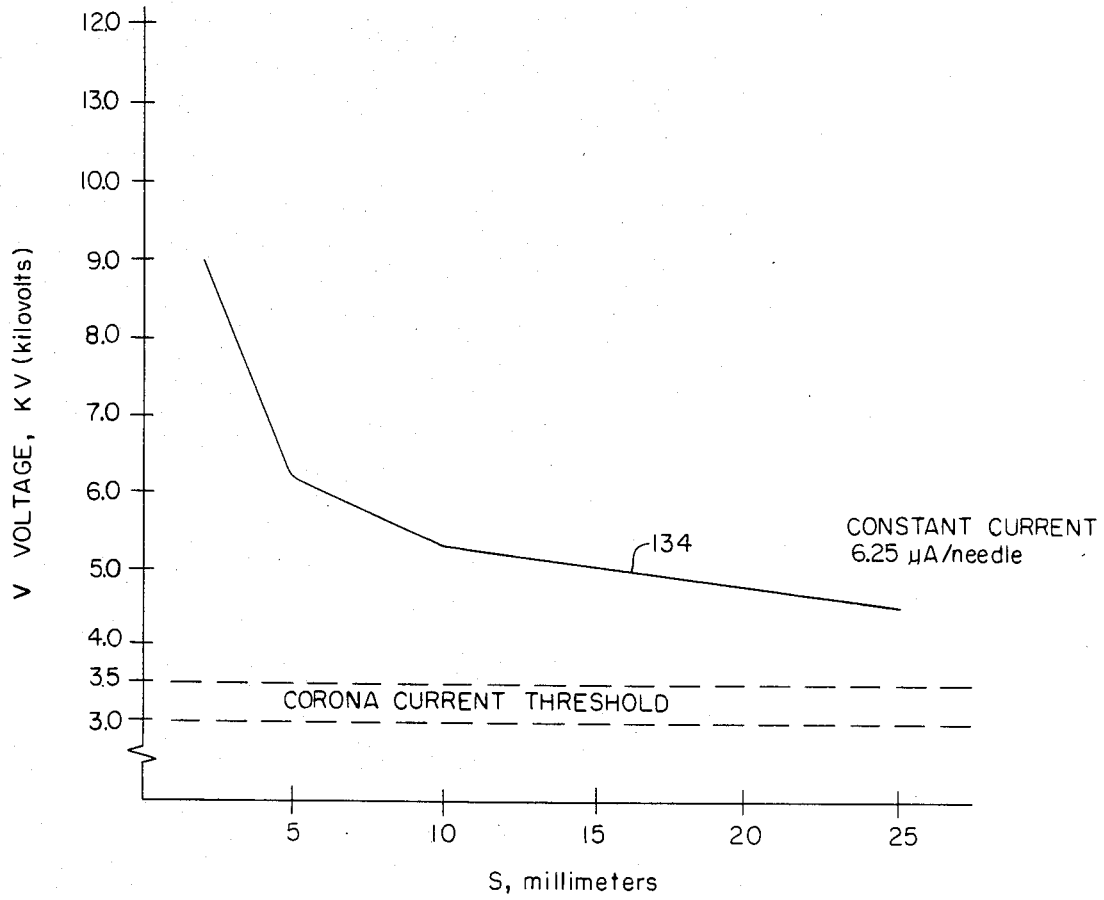
FIG. 10 is a graph showing field voltage as a function of the needle length for the mechanical electrode according to the invention illustrated in FIGS. 8 and 9, the current being conducted by the needle being held constant at 6.25 $\mu$A (microampere) for generating optimum corona current.

To demonstrate the effectiveness of the location of the tip 80 away from the conductive base plate 90 and heating element 22, testing of various needle lengths was done in a fixture set-up according to the illustrated embodiment of FIGS. 8 and 9 and the results are generally plotted on the graph of FIG. 10. The test fixture contained the essential elements of the present disclosure including the current-limiting resistive material 96 assembled according to the embodiment of FIGS. 4 and 4A. In the test fixture of FIGS. 8 and 9, the needle tips 80 are typically spaced apart about 12.5 mm (millimeters) or $\frac{1}{2}$ inch, as is denoted by S″ in FIG. 8. An upper most surface 132 of the heating element 22 is located vertically above base plate 90 about 10 mm. The distance separating tip 80 from the closest surface 132 of the heating element 22 is denoted by S′. Though various lengths S of the needle 76 were tested, the electrical field 56 was held constant at about 10 mm between tip 80 and the bottom food surface 54. The voltage supplied to the food was varied so that the conducted current of each needle 76 remains constant at about 6.25 $\mu$A (microamperes) corona current which is the optimum current flow per needle location for enhancing heat and mass transfer in this particular application. Each length S of the needles 76 was operated through at least one complete cooking cycle of a like food wherein the oven temperature was raised from room temperature 70° F. to a cooking temperature of about 400° F.

The above-described fixture was used in performing tests of different needle lengths S ranging from below 5 mm to 25 mm (0.2 in to 1.0 in). In the graph of FIG. 10, the needle length S is shown in relation to the voltage (in kilovolts, e.g., 5 kv equals 5000 volts) necessary to generate the 6.25 $\mu$A constant current per needle tip 80. The corona current threshold voltage is found to range from 3 kv to 3.5 kv as is represented by the horizontal dashed lines. The solid line 134 represents a connection of the test results showing the voltage required for maintaining constant current for the different needle lengths S. The profile of line 134 shows that for needle lengths S reducing from 25 mm to 10 mm, a gradually increasing applied voltage from about 4.5 kv to about 5.3 kv is required in order to maintain the constant current per needle 76. Needle lengths S further reduced from 10 mm to 5 mm requires higher increasing voltage of from about 5.3 kv to about 6.2 kv and for needle lengths S less than 5 mm, the required voltage is increasing at an even more rapid rate.

Based on the test data obtained, needle effective lengths S ranging between 25 mm and 10 mm allows the needle 76 to generate optimum corona current (6.25 $\mu$A) by applying voltages of between 4.5 kv and 5.3 kv. This applied voltage range is above the corona current threshold (3.0 kv to 3.5 kv) and below arcing potential (about 10 kv to 12 kv at room temperature and about 8 kv to 10 kv at 400° F.) so that normally arcing between the tip 80 and base plate 90 is avoided. In addition, the spacing S′ between the needle tip 80 and the surface 132 of heating element 22 needs to be considered and should be preferably greater than 10 mm so as to normally avoid arcing therebetween during corona generating operation.

A most preferred configuration of the embodiment of FIG. 8 comprises the needle length S being selected at about 25 mm or about 1.0 inch. The S′ separation from the tip 80 to the surface 132 of the heating element 22 is about 16.3 mm or about 0.65 inch. Thus, the individual tips 80 are located sufficiently away from the conductive base plate 90 and the heating element 22 so that enough resistive gas is in the gaps S and S′ to drop the voltage for preventing arcing during optimum corona current operation at high oven cooking temperatures.

The needle spacing S″ is another factor that affects the required applied voltage necessary to maintain the optimum corona current density of 25 $\mu$A per inch$^2$ (according to my copending application Ser. No. 488,556) in the electrical field 56. In selecting the preferred needle spacing S″, it is preferred that the needles 76 be operating with a minimum corona current per needle relationship that will reliably produce the optimum corona current density. In this regard, the necessary operating voltage is minimized so as to avoid arcing between the needle tips 80 and to use minimum electrical power which has economical benefits.

In the preferred embodiment of FIGS. 8 and 9, the selected needle spacing S″ is set at about 12.5 mm or about 0.5 inch. This 0.5 inch needle spacing S″ was found to satisfactorily meet the preferred operating requirements and was used in the test fixture for accumulating the test data of the graph of FIG. 10. At the 0.5 inch needle spacing S″, each needle 76 supports 6.25 $\mu$A of corona current in order to maintain the optimum corona current density of 25 $\mu$A per inch$^2$. The applied voltage required to cause the needles 76 to generate the proper corona current is of the order of between 4.5 kv and 5.3 kv which is sufficiently above the corona current producing threshold (3.0 kv to 3.5 kv) and safely below arcing potential (8 kv to 10 kv at oven temperatures about 400° F.).

Different needle spacings S″ were tested including spacing distances less than and greater than the selected 0.5 inch spacing. It was discovered that when the needles 76 were uniformly moved together so that the spacing S″ was adjusted less than 0.5 inch, the applied voltage needed to be increased accordingly in order to maintain the proper corona current flow. Moreover, the closer the needles 76 were moved together, the more rapidly the voltage needed to be increased so that arcing conditions between the needle tips 80 were quickly approached. Conversely, needle spacings S″ greater than 0.5 inch were tested and found to effectively reduce the overall operating efficiency of the enhanced heat and mass transfer process. The increased needle spacing S″, greater than 0.5 inch, required increasing electrical field strength hence corona current at each needle to maintain 25 $\mu$A per inch$^2$. The applied corona activity along the food surface 54 became spotty resulting in a non-uniform break-up of the heat resistive film.

In summary, by constructing a mechanical electrode in accordance with the foregoing disclosure, arc suppression at a particular needle location may be accomplished through the current-limiting resistive material discretely associated with each needle and arcing incidents are avoided through the proper positioning of the needle's tip away from any conductive structure including adjacent needle tips in consideration of the voltage necessary for each needle to generate a particular corona current. In suppressing an arc at the particular needle location, the remaining needles are allowed to continue in corona current operation without interruption.

Though the above disclosed embodiments for the mechanical electrode have been shown and disclosed in connection enhancing heat and mass transfer at the bottom food surface, applicant recognizes that the principles taught herein for localized arc suppression may be utilized in connection with other needle electrodes that may be employed in the oven to enhance heat and mass transfer at other food surfaces, such as, the top food surface.

It will be understood that various changes in the details and arrangements; having been described and illustrated herein, may be made by those skilled in the art within the principle and scope of the invention as defined in the appended claims.

What is claimed is:

1. A mechanical electrode for use in an electrical circuit in a cooking appliance having a heating element means to cook food, the electrical circuit including a voltage power supply electrically connected to communicate voltage to the food, a surface of the food being in spaced relationship to the mechanical electrode for defining an electrical field for supporting electrical current, and a voltage control means interposed between the mechanical electrode and the voltage power supply for regulating the voltage supplied to the food for maintaining constant current flow in the field, the mechanical electrode operating at a different potential with respect to the food for establishing current contact with the food through the electrical field; the mechanical electrode comprising;

a plurality of electrically conductive needle elements, each of said needle elements having a pointed tip opposing the food surface, each said pointed tip being in current contact with an aligned portion of the food surface, said tip having a proximate voltage concentration determined by the voltage supply from the food through the electrical field and said voltage concentration normally being below an arcing potential for causing said pointed tip to generate corona current used to enhance heat and mass transfer at the food surface;

a plate member supporting and electrically interconnecting said plurality of needle elements, said plate member being electrically coupled to the voltage control means for communicating conducted current from said needle elements to the voltage control means; and an electrical resistive material forming a discrete path of current-limiting resistivity, said electrical resistive material electrically connecting each one of said needle elements to said plate member and being operable to electrically isolate an individual needle element from adjacent needle elements and from said plate member when said voltage concentration proximate said pointed tip of said individual needle element approaches arcing potential, said pointed tip of each one of said adjacent needle elements continuing in corona current generating operation while said resistive material associated with one of said needle elements is absorbing voltage to suppress the formation of an arc.

2. A mechanical electrode according to claim 1 wherein said resistive material affords a current-limiting resistivity thereacross in a range of about 5% to about 20% of the current-limiting resistivity through the electrical field when the applied voltage is causing said pointed tip to generate corona current sufficient for enhancing heat and mass transfer at the food surface.

3. A mechanical electrode according to claim 1 further comprising;

said plate member made from an electrically conductive material;

means supporting each one of said plurality of needle elements in a spaced relationship to said plate member; and said electrical resistive material integrally connecting each one of said plurality of needle elements to said plate member.

4. A mechanical electrode according to claim 1 wherein each one of said plurality of needle elements is a casting construction made from said electrical resistive material.

5. A mechanical electrode according to claim 1 wherein the heating element is distributed among said plurality of needle elements and having a vertical relationship interposing said pointed tip and said plate member such that the heating element is closer to said plate member than said pointed tip.

6. A mechanical electrode according to claim 5 wherein a first resistive gap S is the spacing from said pointed tip to said plate member, a second resistive gap S″ is the spacing from said pointed tip to the heating element, and a third resistive gap S″ is the typical spacing from one pointed tip to any adjacent pointed tip, said resistive gaps S, S′ and S″ are dimensionally selected, so that enough voltage may be dropped thereacross to prevent arcing when the applied voltage is of sufficient magnitude to generate corona current and in combination with said resistive material enough voltage may be dropped across said gaps to prevent arcing when the voltage concentration proximate any one pointed tip approaches arcing potential.

7. A mechanical electrode for use in an electrical circuit in a cooking appliance having an heating element means to cook food, the electrical circuit including a voltage power supply electrically connected to communicate voltage to the food, a surface of the food being in spaced relationship to the mechanical electrode for defining an electrical field for supporting electrical current, and a voltage control means interposed between the mechanical electrode and the voltage power supply for regulating the voltage supplied to the food for maintaining constant current flow in the field, the mechanical electrode operating at a different potential with respect to the food for establishing current contact with the food through the electrical field; the mechanical electrode comprising:

a plurality of electrically conductive needle elements, each of said needle elements having a pointed tip opposing the food surface, each said pointed tip being in current contact with an aligned portion of the food surface, said tip having a proximate voltage concentration determined by the voltage supply from the food through the electrical field and said voltage concentration normally being below an arcing potential for causing said pointed tip to generate corona current used to enhance heat and mass transfer at the food surface;

a plate member made from an electrically conductive material for electrically interconnecting said plurality of needle elements, said plate member being electrically coupled to the voltage control means for communicating conducted current from said needle elements to the voltage control means;

a supporting means for supporting each one of said plurality of needle elements in a spaced relationship to said plate member, said supporting means comprising a housing structure made from an electrically insulated material; and an electrical resistive material located outboard of said housing structure forming a discrete path of current-limiting resistivity, said electrical resistivity material electrically integrally connecting each one of said plurality of needle elements to said plate member and operable to electrically isolate an individual needle element from adjacent needle elements from said plate member when said voltage concentration proximate said pointed tip of said individual needle element approaches arcing potential, said pointed tip of each one of said adjacent needle elements continuing in corona current generating operation while said resistive material associated with one of said needle elements is absorbing voltage to suppress the formation of an arc.

8. A mechanical electrode according to claim 7 wherein said resistive material is attached along on outer surface of said housing structure.

9. A mechanical electrode for use in an electrical circuit in a cooking appliance having an heating element means to cook food, the electrical circuit including a voltage power supply electrically connected to communicate voltage to the food, a surface of the food being in spaced relationship to the mechanical electrode for defining an electrical field for supporting electrical current, and a voltage control means interposed between the mechanical electrode and the voltage power supply for regulating the voltage supplied to the food for maintaining constant current flow in the field, the mechanical electrode operating at a different potential with respect to the food for establishing current contact with the food through the electrical field; the mechanical electrode comprising:

a plurality of electrically conductive needle elements, each of said needle elements having a pointed tip opposing the food surface, each said pointed tip being in current contact with an aligned portion of the food surface, said tip having a proximate voltage concentration determined by the voltage supply from the food through the electrical field and said voltage concentration normally being below an arcing potential for causing said pointed tip to generate corona current used to enhance heat and mass transfer at the food surface;

a plate member made from an electrically conductive material for electrically interconnecting said plurality of needle elements, said plate member being electrically coupled to the voltage control means for communicating conducted current from said needle elements to the voltage control means;

a supporting means for supporting each one of said plurality of needle elements in a spaced relationship to said plate member, said supporting means comprising an electrically insulative housing having a through opening, each one of said needle elements extending partially within said through opening; and an electrical resistive material filling the remainder of said through opening forming a discrete path of current-limiting resistivity, said electrical resistivity material electrically integrally connecting each one of said plurality of needle elements to said plate member and operable to electrically isolate an individual needle element from adjacent needle elements from said plate member when said voltage concentration proximate said pointed tip of said individual needle element approaches arcing potential, said pointed tip of each one of said adjacent needle elements continuing in corona current generating operation while said resistive material associated with one of said needle elements is absorbing voltage to suppress the formation of an arc.

10. A mechanical electrode for use in an electrical circuit in a cooking appliance having an heating element means to cook food, the electrical circuit including a voltage power supply electrically connected to communicate voltage to the food, a surface of the food being in spaced relationship to the mechanical electrode for defining an electrical field for supporting electrical current, and a voltage control means interposed between the mechanical electrode and the voltage power supply for regulating the voltage supplied to the food for maintaining constant current flow in the field, the mechanical electrode operating at a different potential with respect to the food for establishing current contact with the food through the electrical field; the mechanical electrode comprising:

a plurality of electrically conductive needle elements, each of said needle elements having a pointed tip opposing the food surface, each said pointed tip being in current contact with an aligned portion of the food surface, said tip having a proximate voltage concentration determined by the voltage supply from the food through the electrical field and said voltage concentration normally being below an arcing potential for causing said pointed tip to generate corona current used to enhance heat and mass transfer at the food surface;

a plate member made from an electrically insulative material for supporting said plurality of needle elements;

a continuous tracing of electrically conductive material on one surface of said plate member forming a pattern among said needle elements, and electrically interconnecting said plurality of needle elements with said electrical conductive material, said electrical conductive material being coupled to the voltage control means for communicating conducted current from said needle elements to the voltage control means;

an electrical resistive material integrally connecting each one of said plurality of needle elements to said pattern of conductive material and operable to electrically isolate an individual needle element from adjacent needle elements and from said plate member when said voltage concentration proximate said pointed tip of said individual needle element approaches arcing potential, said pointed tip of each one of said adjacent needle elements continuing in corona current generating operation while said resistive material associated with one of said needle elements is absorbing voltage to suppress the formation of an arc.

11. A mechanical electrode according to claim 10 wherein said electrical resistive material associated with each one of said plurality of needle elements is in a form of a resistive material stripe layered on said one surface.

* * * * *